US010038248B1

(12) United States Patent
Ramirez et al.

(10) Patent No.: US 10,038,248 B1
(45) Date of Patent: Jul. 31, 2018

(54) THREE-DIMENSIONALS RFID TAGS

(71) Applicants: Ramiro Augusto Ramirez, Tampa, FL (US); Thomas McCrea Weller, Lutz, FL (US); Eduardo Antonio Rojas, Temple Terrace, FL (US)

(72) Inventors: Ramiro Augusto Ramirez, Tampa, FL (US); Thomas McCrea Weller, Lutz, FL (US); Eduardo Antonio Rojas, Temple Terrace, FL (US)

(73) Assignee: University of South Florida, Tampa, FL (US)

( * ) Notice: Subject to any disclaimer, the term of this patent is extended or adjusted under 35 U.S.C. 154(b) by 71 days.

(21) Appl. No.: 15/202,783

(22) Filed: Jul. 6, 2016

Related U.S. Application Data

(60) Provisional application No. 62/196,287, filed on Jul. 23, 2015.

(51) Int. Cl.
*H01Q 1/22* (2006.01)
*H01Q 9/28* (2006.01)
*H01Q 1/36* (2006.01)

(52) U.S. Cl.
CPC ..... *H01Q 9/285* (2013.01); *H01Q 1/2225* (2013.01); *H01Q 1/36* (2013.01)

(58) Field of Classification Search
USPC ..... 343/795
See application file for complete search history.

(56) References Cited

U.S. PATENT DOCUMENTS

| | | | | |
|---|---|---|---|---|
| 8,319,694 | B2 | 11/2012 | Yang | |
| 8,381,998 | B1 | 2/2013 | Chang | |
| 9,836,685 | B1 * | 12/2017 | Ramirez | G06K 19/07722 |
| 2007/0120677 | A1 | 5/2007 | Park | |
| 2008/0055045 | A1 | 3/2008 | Swan | |
| 2008/0111688 | A1 | 5/2008 | Nikitin | |
| 2010/0065647 | A1 * | 3/2010 | Ritamaki | G06K 19/041 235/492 |
| 2012/0235870 | A1 * | 9/2012 | Forster | H01Q 7/00 343/728 |
| 2015/0198708 | A1 * | 7/2015 | Khan | G01S 13/38 342/146 |
| 2015/0288424 | A1 * | 10/2015 | Tedjini | G06K 19/07766 455/41.1 |

FOREIGN PATENT DOCUMENTS

WO 2014/057464 A4 4/2014

OTHER PUBLICATIONS

Phatarachaisakul, Pumpoung et al, Tag Antenna Using Printed Dipole with H-Slot for UHF RFID applications, Proceedings of the International Electrical Engineering Congress 2014.*

(Continued)

*Primary Examiner* — Albert K Wong
(74) *Attorney, Agent, or Firm* — Thomas | Horstemeyer, LLP

(57) ABSTRACT

In one embodiment, a radio-frequency identification (RFID) tag includes multiple orthogonal substrates, a passive RFID integrated circuit chip mounted to one of the substrates, and a three-dimensional tag antenna electrically connected to the chip and extending to each of the orthogonal substrates.

25 Claims, 4 Drawing Sheets

(56) References Cited

OTHER PUBLICATIONS

Rao, K. V. S., Sander F. Lam, and Pavel V. Nikitin. "UHF RFID tag for metal containers." Microwave Conference Proceedings (APMC), 2010 Asia-Pacific. IEEE, 2010.
Lee, J-W., and B. Lee. "Design of high-Q UHF radio-frequency identification tag antennas for an increased read range." IET microwaves, antennas & propagation 2.7 (2008): 711-717.
Hodges, Steve, et al. "Assessing and optimizing the range of UHF RFID to enable real-world pervasive computing applications." Pervasive Computing. Springer Berlin Heidelberg, 2007. 280-297.

* cited by examiner

THREE-DIMENSIONALS RFID TAGS

CROSS-REFERENCE TO RELATED APPLICATION

This application claims priority to U.S. Provisional Application Ser. No. 62/196,287, filed Jul. 23, 2015, which is hereby incorporated by reference herein in its entirety.

BACKGROUND

Many new radio-frequency identification (RFID) applications have been introduced into the market in recent years. Naturally, all such applications would benefit from RFID tags that are smaller, lighter, and have greater read range.

Although studies have been conducted that have focused on improving the performance of planar antennas, high-frequency antennas have been successfully fabricated using three-dimensional fabrication techniques, such as additive manufacturing. These antennas have been fabricated using thermoplastics having a low loss tangent (as compared to commercially available substrates) such as acrylonitrile butadiene styrene (ABS) and silver-based conductive paste (e.g., Dupont CB028). Such materials can be printed in a conformal manner and used to form non-planar three-dimensional printed devices.

In view of the availability of three-dimensional fabrication techniques, it would be desirable to fabricate RFID tag antennas using these techniques in order to obtain improved results in terms of one or more of cost, size, weight, and read distance.

BRIEF DESCRIPTION OF THE DRAWINGS

The present disclosure may be better understood with reference to the following figures. Matching reference numerals designate corresponding parts throughout the figures, which are not necessarily drawn to scale.

FIGS. 5A and 5B are graphs that show E-Plane (FIG. 5A) and H-plane (FIG. 5B) results for simulated (short dash), measured ABS (long dash), and measured Rogers (solid) tag antennas.

DETAILED DESCRIPTION

As described above, it would be desirable to fabricate radio-frequency identification (RFID) tag antennas using three-dimensional fabrication techniques in order to obtain improved results in terms of one or more of cost, size, weight, and read distance. Disclosed herein are three-dimensional RFID tags that are fabricated using such techniques. In some embodiments, the tags comprise a passive RFID integrated circuit (IC) chip and a three-dimensional tag antenna that is electrically connected to the chip. In some embodiments, the tag antenna is a dipole antenna having arms that comprise conductive lines that have been deposited on multiple orthogonally arranged substrates that together form an open-toped rectangular hexahedron. In some embodiments, the impedance matching between the antenna arms and the passive RFID IC chip is accomplished with an H-slot matching technique to obtain a simulated 10 dB return loss bandwidth that enables the tag to operate in the American and European ISM RFID bands of 902-928 MHz and 864-868 MHz, respectively.

In the following disclosure, various specific embodiments are described. It is to be understood that those embodiments are example implementations of the disclosed inventions and that alternative embodiments are possible. All such embodiments are intended to fall within the scope of this disclosure.

Described in this disclosure is a three-dimensional approach used to design and manufacture RFID tags comprising a three-dimensional tag antenna that is connected to a RFID integrated circuit (IC) chip. The antennas are designed so as to provide a good impedance match at the ports of the chip and the highest gain possible to improve the read range. In addition, goals such as lower cost, lighter weight, smaller footprint, and smaller volume are achieved. As described below, additive manufacturing was used to fabricate a three-dimensional tag antenna that provides a return loss greater than 10 dB and a simulated gain of 1.63 dBi, using acrylonitrile butadiene styrene (ABS) and Dupont CB028 silver-based conductive paste. The same design was also fabricated using a commercially available substrate that has similar electrical properties as ABS (Rogers Duroid RT 5870) for the purpose of benchmarking. These two antennas were compared with similarly sized commercial RFID tags and showed better read ranges.

Figure 1A:
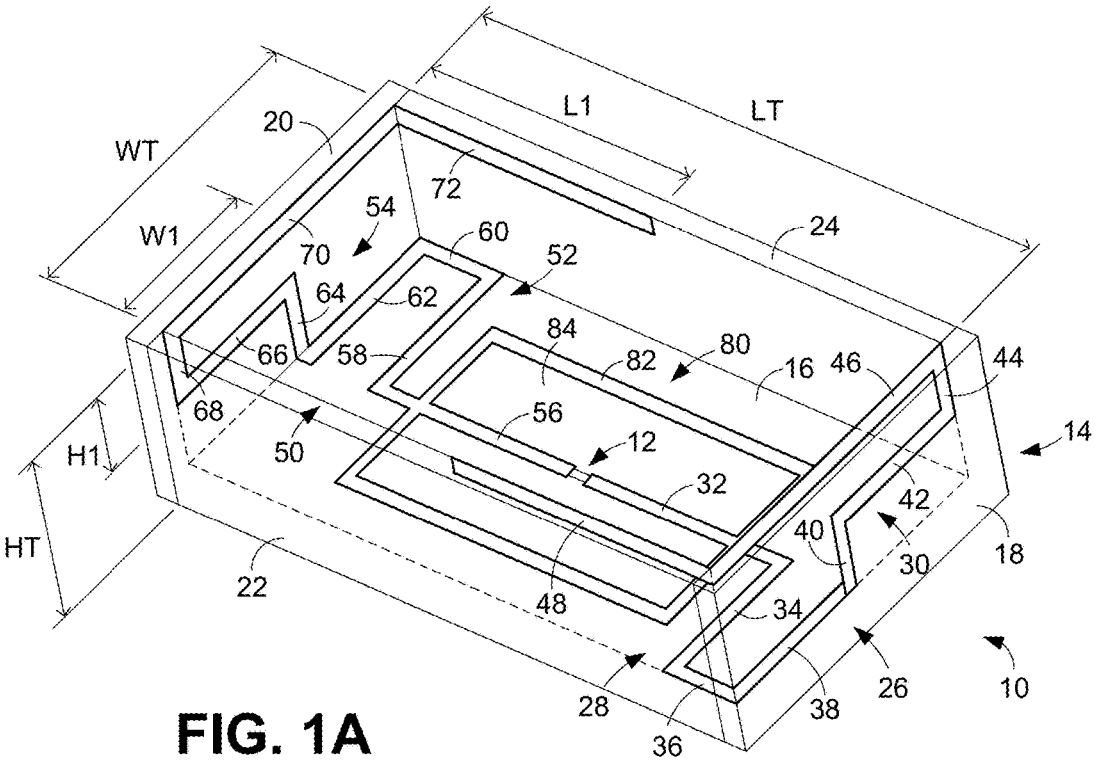
FIG. 1A is a perspective view of an embodiment of a three-dimensional radio-frequency identification (RFID) tag.
Figure 1B:
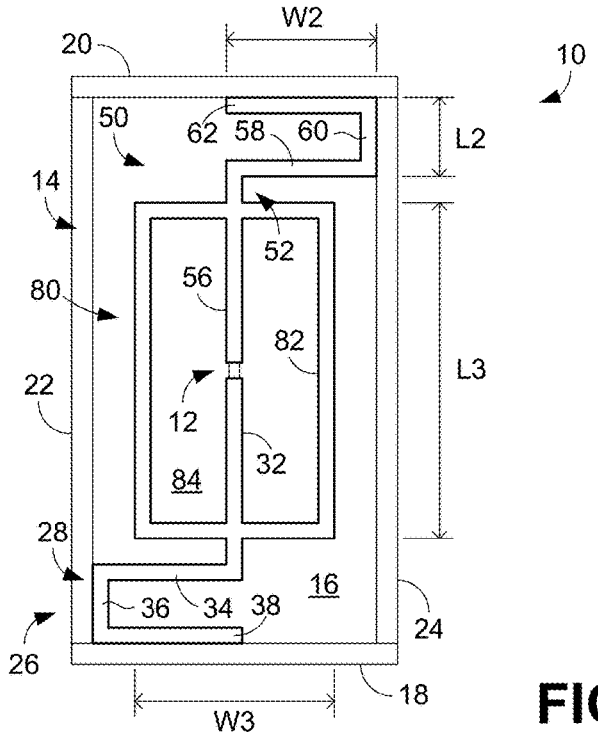
FIG. 1B is a plan view of the RFID tag of FIG. 1A.

FIG. 1 illustrates an embodiment of a three-dimensional RFID tag 10. More particularly, FIG. 1A shows the tag 10 in a top perspective view while FIG. 1B shows the tag in a top (plan) view. Generally speaking, the tag 10 comprises an RFID IC chip 12 that is electrically coupled to a three-dimensional tag antenna 14. By way of example, the RFID IC chip 12 can comprise NXP's UCODE G2iL SL3S1203_1213 passive RFID chip, which has a sensitivity of −18 dBm and a 128-bit EPC memory including 64 bits for tag identification (TID). The reported normal mode input impedance for this RFID chip is $Z_{in}$=(25−j237) Ω and $Z_{in}$=(23−j224) Ω at 866 MHz and 915 MHz, respectively. The communication between the RFID reader board and the RFID chip 12 is compliant with the Class 1 Generation 2 ISO 18000-6C protocol. Because the passive RFID IC chip's normal mode input impedance does not show a strong frequency dependent behavior, the tag antenna 14 can be designed using the H-slot matching technique to be conjugate matched with the RFID IC chip 12 for the maximum power transfer possible, covering the European ISM RFID band (862-868 MHz) and the American ISM RFID band (902-928 MHz). This approach makes the tag antenna 14 suitable for worldwide RFID applications.

In some embodiments, the tag antenna 14 operates as a dual-band radiator by selecting the center frequency between the European and the American RFID bands. In such a case, an 894 MHz half-wavelength dipole can be implemented. A single antenna arm length of 84 mm could be used in such an application because this distance represents approximately one quarter wavelength of an 894 MHz wave in free space. However, an 84 mm arm leads to a single planar two-dimensional model with a total length of 190 mm, which might be too large for applications in which the required volume is reduced and only a smaller antenna can be implemented. Accordingly, a three-dimensional tag antenna geometry is implemented in the tag 10 to reduce its footprint.

The tag antenna 14 illustrated in FIGS. 1A and 1B is a three-dimensional half-wave dipole antenna. As shown most clearly in FIG. 1A, the antenna 14 is formed on multiple substrates that together form part of an open-topped rectangular hexahedron (i.e., an open-topped, five-sided rectangular box). In the illustrated embodiment, these substrates include a base substrate 16 to which the RFID IC chip 12 is mounted, opposed first and second end substrates 18 and 20, and opposed first and second lateral substrates 22 and 24. While these substrates 18-24 can be independent substrates that are joined together after they are separately fabricated, it is noted that they can, in other embodiments, be unitarily formed as a single piece of same material in an additive manufacturing context. Irrespective of how they are formed, each of the substrates 18-24 is orthogonal to the other substrates. In the orientation shown in FIG. 1A, the base substrate 16 is contained in a horizontal plane while the end substrates 18, 20 and the lateral substrates 22, 24 are contained in separate vertical planes. Each substrate is composed of a dielectric material and comprises an inner surface that faces the interior of the hexahedron and an outer surface that faces outward from the hexahedron. By way of example, the substrates can have thicknesses of approximately 60 mils and form rectangular box that is approximately 41 mm long, 23 mm wide, and 11.52 mm tall. This provides a reduction in length of 78% relative to a planar two-dimensional design.

With further reference to FIGS. 1A and 1B, the tag antenna 14 comprises two separate quarter-wavelength dipole arms comprising conductive lines or segments that extend from the RFID IC chip in opposite directions along a longitudinal axis of the RFID tag 10. A first three-dimensional dipole arm 26 comprises a first or horizontal portion 28 formed on the inner surface of the base substrate 16 (and therefore lies in the horizontal plane) and a vertical portion 30 that extends upward from the base substrate and along the inner surfaces of the second end substrate 20 and the first lateral substrate 22 (and therefore lies in two different orthogonal, vertical planes). In the illustrated embodiment, the horizontal portion 28 includes a first longitudinal segment 32 that extends outwardly from the RFID IC chip 12 at a center of the first substrate 16 along a longitudinal direction of the RFID tag 10 toward the first end substrate 18, a first transverse segment 34 that extends outwardly from the first longitudinal segment 32 along a transverse direction of the tag to the first lateral substrate 22, a second longitudinal segment 36 that extends outwardly from the first transverse segment 34 along the longitudinal direction of the tag and along the first lateral substrate 22 to the first end substrate 18, and a second transverse segment 38 that extends inwardly from the second longitudinal segment 36 along the transverse direction of the tag and along the first end substrate 18 toward the second lateral substrate 24. Accordingly, the horizontal portion 28 of the first dipole arm 26 forms a first meandered portion of the first dipole arm 26.

In the illustrated embodiment, the vertical portion 30 of the first dipole arm 26 comprises a first vertical segment 40 that extends upwardly from the second transverse segment 38 along the first end substrate 18, a first horizontal segment 42 that extends outwardly from the first vertical segment 40 along the transverse direction of the tag to the second lateral substrate 24, a second vertical segment 44 that extends upwardly from the first horizontal segment 42 along the second lateral substrate 24 to a top edge of the first end substrate 18, a third horizontal segment 46 that extends inwardly from the second vertical segment 44 along the transverse direction of the tag and along the top edge of the first end substrate 18 to the first lateral substrate 22, and a fourth horizontal segment 48 that extends inwardly from the third horizontal segment 46 along the longitudinal direction of the tag and along a top edge of the first lateral substrate 22 toward the second end substrate 20. Accordingly, the vertical portion 30 of the first dipole arm 26 forms a second meandered portion of the first dipole arm 26.

A second three-dimensional dipole arm 50, which is anti-symmetrical to the first dipole arm 26, comprises a first or horizontal portion 52 that is formed on the inner surface of the base substrate 16 (and therefore lies in the horizontal plane) and a vertical portion 54 that extends upward from the base substrate and along the inner surfaces of the first end substrate 18 and the second lateral substrate 24 (and therefore lies in two different orthogonal, vertical planes). In the illustrated embodiment, the horizontal portion 52 includes a first longitudinal segment 56 that extends outwardly from the RFID IC chip 12 at the center of the first substrate 16 along the longitudinal direction of the RFID tag 10 toward the second end substrate 20, a first transverse segment 58 that extends outwardly from the first longitudinal segment 56 along the transverse direction of the tag to the second lateral substrate 24, a second longitudinal segment 60 that extends outwardly from the first transverse segment 58 along the longitudinal direction of the tag and along the second lateral substrate 24 to the second end substrate 20, and a second transverse segment 62 that extends inwardly from the second longitudinal segment 60 along the transverse direction of the tag and along the second end substrate 20 toward the first lateral substrate 22. Accordingly, the horizontal portion 52 of the second dipole arm 50 forms a first meandered portion of the second dipole arm 50.

In the illustrated embodiment, the vertical portion 54 of the second dipole arm 50 comprises a first vertical segment 64 that extends upwardly from the second transverse segment 62 along the second end substrate 20, a first horizontal segment 66 that extends outwardly from the first vertical segment 64 along the transverse direction of the tag to the first lateral substrate 22, a second vertical segment 68 that extends upwardly from the first horizontal segment 66 along the first lateral substrate 22 to a top edge of the second end substrate 20, a third horizontal segment 70 that extends inwardly from the second vertical segment 68 along the transverse direction of the tag and along the top edge of the second end substrate 20 to the second lateral substrate 24, and a fourth horizontal segment 72 that extends inwardly from the third horizontal segment 70 along the longitudinal direction of the tag and along a top edge of the second lateral substrate 24 toward the first end substrate 18. Accordingly, the vertical portion 30 of the first dipole arm 26 forms a second meandered portion of the second dipole arm 50.

In some embodiments, each of the dipole arms 26, 32 is approximately 1 mm wide along its entire length. As is further shown in FIGS. 1A and 1B, the first and second dipole arms 26, 32 are coupled to a matching network 80 that comprises a continuous, rectangular matching loop 82 that surrounds the RFID IC chip 12 and the inner portions of the longitudinal segments 32 and 56 of the first and second dipole arms 26 and 50, respectively. Together, the matching loop 82 and the segments 32 and 56 form an H-slot 86 having two parallel longitudinal open sections on either side of the RFID IC chip 12 that are joined by a center transverse open section in which the chip is positioned. Example dimensions for variables identified in FIGS. 1A and 1B for the dipole arms 26, 50 and the continuous matching loop 38 are provided in Table I below.

TABLE I

Example Tag Antenna Dimensions in Millimeters
Tag Antenna Dimensions of Interest

| Variable | Value (mm) | Variable | Value (mm) |
|---|---|---|---|
| LT | 38 | WT | 20 |
| L1 | 18 | W1 | 10.5 |
| L2 | 5.5 | W2 | 10.5 |
| L3 | 23 | W3 | 14 |
| HT | 11.524 | H1 | 5 |

Figure 2:
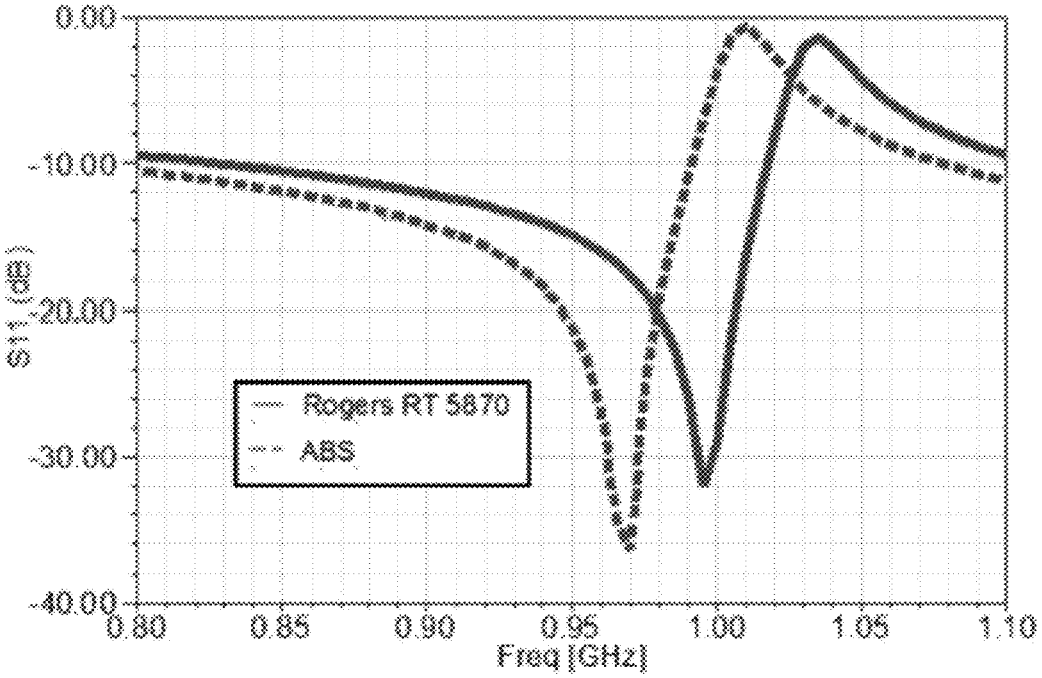
FIG. 2 is a graph that shows the simulated reflection coefficient of a three-dimensional tag antenna similar to that shown in FIG. 1 incorporating ABS and Rogers substrates.

Two dielectric materials having similar characteristics were evaluated for use in the construction of the tag substrates. These materials were ABS ($\varepsilon_r$ ~2.6 and tan δ ~0.0052) and Rogers Duroid RT5870 ($\varepsilon_r$ ~2.33 and tan δ ~0.0012). Simulations were performed with Ansys HFSS 15 and the simulated reflection coefficient over frequency is shown in FIG. 2. The dipole was conjugate-matched to the RFID IC chip impedance by an H-slot with dimensions of 23 mm×14 mm. The resonant frequency of the ABS board and Rogers Duroid RT 5870 design were optimized to have a 10 dB return loss bandwidth of 28.86% (Rogers) and 33.69% (ABS) covering the bands of interest as shown.

Figure 3:
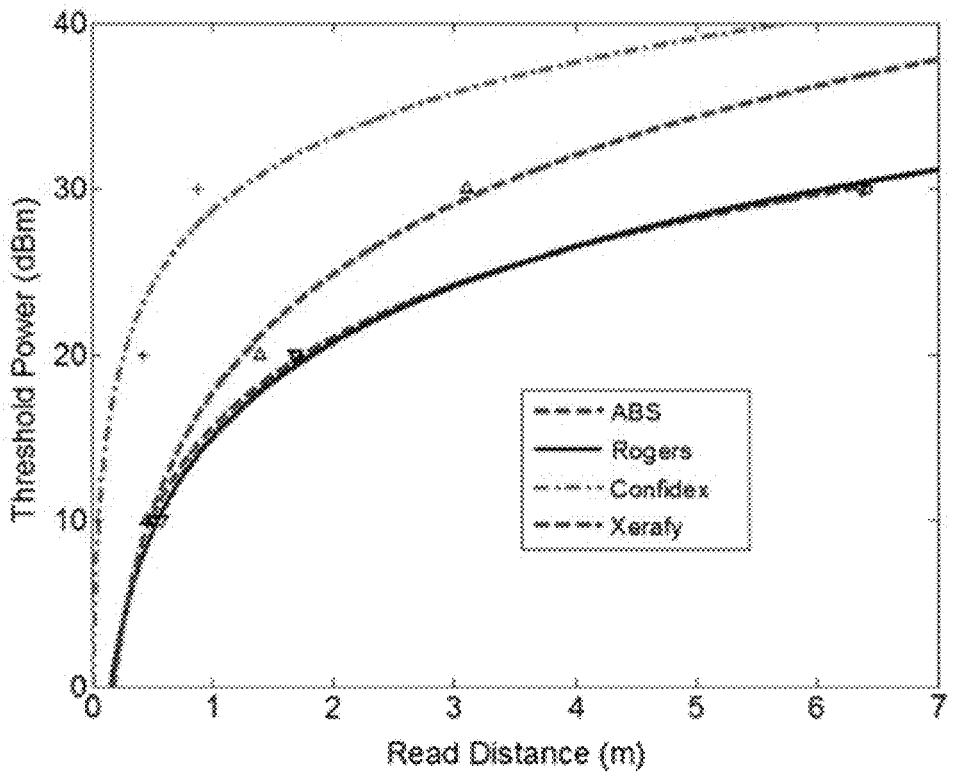
FIG. 3 is a photograph of two fabricated three-dimensional tag antennas constructed using Rogers Duroid RT5870 (left) and ABS (right).

Two different fabrication methods were used to create three-dimensional tag antennas similar to that shown in FIG. 1. In a first method, direct digital manufacturing (DDM) was employed to realize rectangular substrates that can form the hexahedron and support the metallization lines (see FIG. 3). The dielectric substrates were fabricated with a fused deposition modeling (FDM) three-dimensional printer (Stratasys Uprint).

ABS was used, which is a thermoplastic commonly utilized in additive manufacturing. The electrical properties of this material were extracted using the measured S parameters of a resonant cavity manufactured by Damaskos Inc. These parameters were a relative dielectric permittivity ($\varepsilon_r$) of 2.6 and loss tangent of 0.0052 at 1.19 GHz. The conductive layer was fabricated using an nScrypt Tabletop three-dimensional printer. Employing microdispensing, a silver-based conductive paste (Dupont CB028) was printed on top of the ABS substrates at a speed of 25 mm/s and a pressure of 12 psi using a 125 um inner diameter ceramic tip. The substrates were then cured at 90° C. for 1 hour. The hexahedron was then assembled using a commercial two-part epoxy resin and the electrical connection in between the antenna arms and to the RFID IC chip was made by manual application of silver-based conducting paste to fill the gaps.

The second fabrication method that was used traditional photolithography, i.e., copper etching and soldering, utilizing the Rogers Duroid RT5870. The same design dimensions were used to fabricate a clear field photomask. A two-part epoxy resin was utilized to assemble the hexahedron and the copper traces were electrically connected using solder. The RFID IC chip was connected manually using the silver-based conductive paste.

A feed network comprising a balun and a matching network was also fabricated for testing purposes. Two copies of the same feed network (one for each antenna) were fabricated using the same Rogers substrate: An L-section topology of two shunt capacitors of 0.8 pF (Passive Plus Inc.) and one series inductor of 24 nH (Coilcraft), followed by a 900 MHz balun (0900BL18B200E Johanson Technology, Inc). The feed networks were attached to the tag antennas using the two-part resin epoxy and electrically connected using the silver-based conductive paste.

Figure 4A:
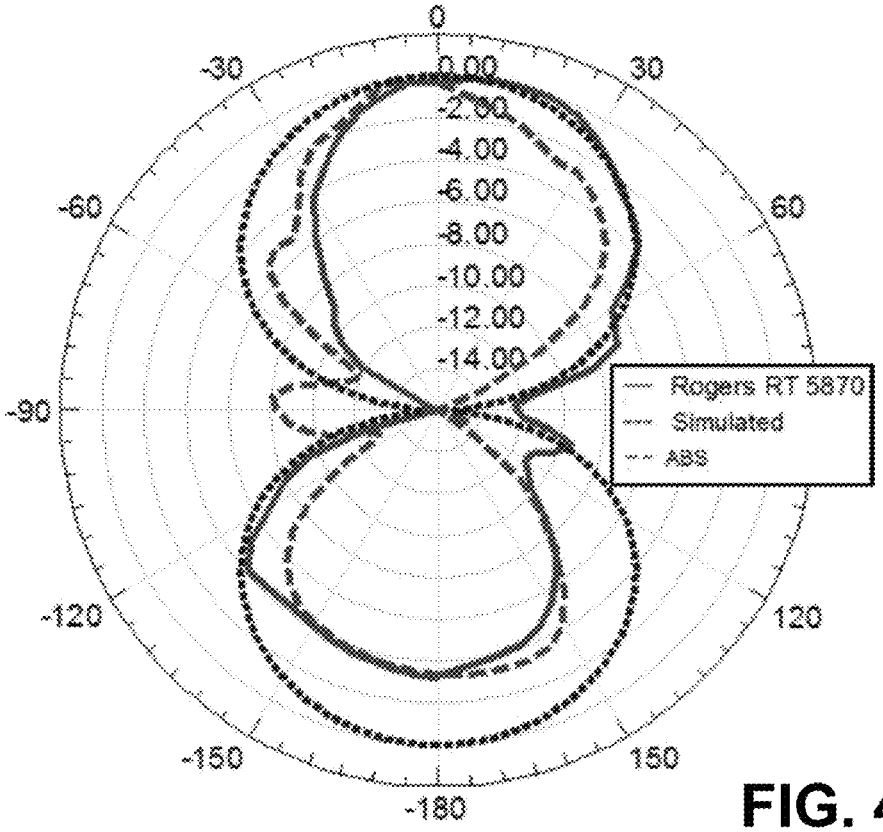
FIG. 4 is a graph that provides a read distance comparison for multiple three-dimensional RFID tag designs.
Figure 4B:
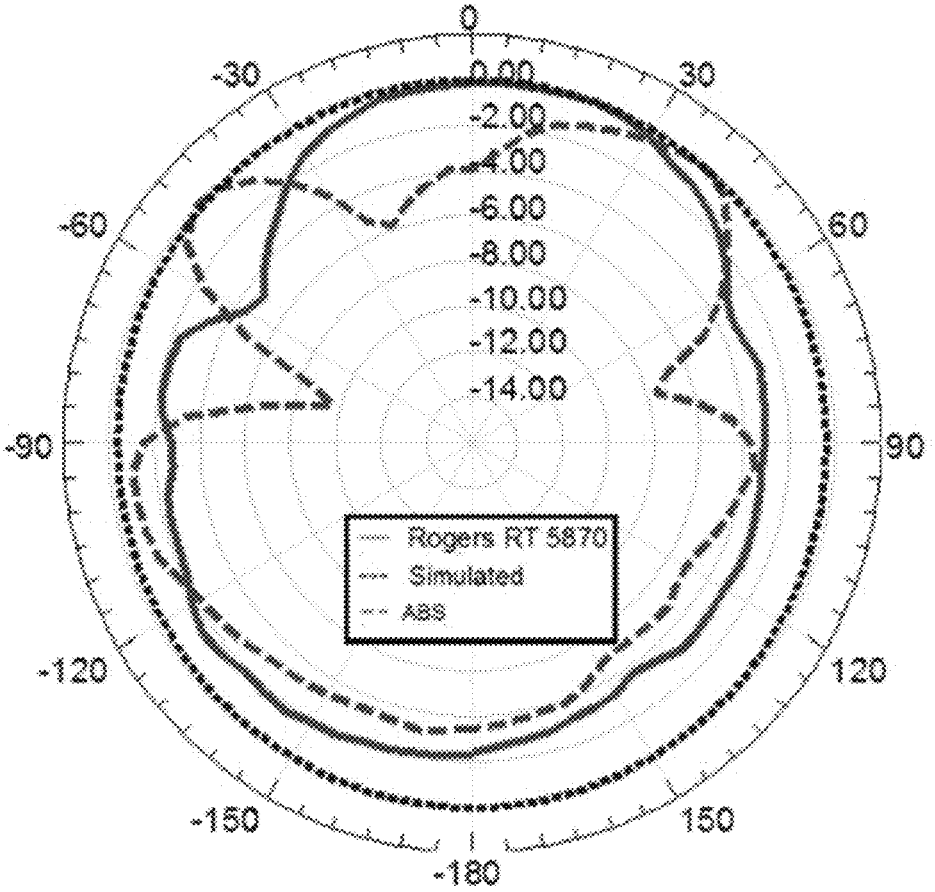

The performance of the fabricated RFID tags was compared with two commercially available versions similar in size: the Confidex Steelwave Micro II and that Xerafy Microx II (see Table II). These two tags are far-field RFID tags with a specified read range of 5 m and 10 m (according to datasheets), respectively. The benchmarking was performed inside an anechoic chamber using a fixture so that the distance from the reader and the tag was manually adjustable. The distance was measured using a Bosch GLM 15 compact laser measure device. The CS101 Handheld RFID reader was employed to measure the read range for each of the tags. FIG. 4 shows the reader power setting (threshold power) versus the read distance. In this case, for each power setting level (10, 20, and 30 dBm) the maximum read distance for each tag was measured. The data was fitted with a far-field model, proportional to $\log_{10}(1/d^2)$ (behavior consistent with the Friis equation), where d is the separation in between the reader and the tag. For a 30 dBm threshold power, the three-dimensional RFID tags reach a read distance of 6.36 meters (ABS) and 6.4 m (Rogers) as compared to 0.715 m (Confidex), and 2.69 m (Xerafy). This performance represents a 136.43% read range improvement with respect to the Xerafy tag, which is also 22.6 g heavier and larger in size than the proposed ABS tag.

TABLE II

Tag Weight and Size Comparison

| Tag | Size | Weight |
|---|---|---|
| Confidex Steelwave Micro II | 51 × 36.3 × 7.5 $mm^3$ | 2 g |
| Xerafy Microx II | 38 × 13 × 4.5 $mm^3$ | 26 g |
| ABS-3D Printed | 41 × 23 × 11.52 $mm^3$ | 3.4 g |
| Rogers-Photolitography | 41 × 23 × 11.52 $mm^3$ | 9.2 g |

The balun described above was used to transform the balanced port of the RFID chip to an unbalanced (coaxial) 50Ω impedance. With this transformation, the radiation patterns of the antenna constructed of ABS and the antenna constructed of Rogers Duroid RT5870 material were measured inside an anechoic chamber. FIG. 5 shows the simulated and measured E-Plane (FIG. 5A) and H-Plane (FIG. 5B) normalized patterns. The simulated gain was 1.63 dBi for the ABS antenna and 1.8 dBi for the Rogers antenna. The patterns of the tags had some deviation when compared to the simulated one, which can be caused by the presence of the feed circuit (including the coaxial connector) placed in the center of the tag.

The above results establish that low-cost, three-dimensional RFID tag antennas can provide a sizable improvement on read range when compared with similar commercial tags available in the market.

The invention claimed is:

1. A radio-frequency identification (RFID) tag comprising:

multiple orthogonal substrates including a base substrate, opposed parallel first and second end substrates that extend upward from the base substrate, and opposed parallel first and second lateral substrates that extend upward form the base substrate, the end substrates and the lateral substrates being perpendicular to the base substrate, each substrate having an inner surface and an outer surface;

a passive RFID integrated circuit chip mounted to the inner surface of the base substrate; and a three-dimensional tag antenna electrically connected to the chip and including a first three-dimensional dipole arm and a second three-dimensional dipole arm, each dipole arm extending outward from the RFID integrated circuit chip in opposite directions along the inner surface of the base substrate, extending up the inner surface of one of the end substrates, and further extending along the inner surface of one of the lateral substrates, wherein the two dipole arms are anti-symmetrical to each other.

2. The RFID tag of claim 1, wherein tag antenna is a dual-band radiator.

3. The RFID tag of claim 2, wherein the tag antenna has a center frequency of approximately 984 MHz.

4. The RFID tag of claim 1, wherein the substrates together form an open-topped rectangular hexahedron in which the RFID integrated circuit chip and the three-dimensional tag antenna are provided.

5. The RFID tag of claim 1, wherein each dipole arm comprises a first meandered portion formed on the inner surface of the base substrate and a second meandered portion formed on the inside surface of one of the end substrates.

6. The RFID tag of claim 1, wherein the antenna is formed using an additive manufacturing technique in which conductive material is deposited on the substrates.

7. The RFID tag of claim 6, wherein the substrates are made of acrylonitrile butadiene styrene (ABS).

8. The RFID tag of claim 7, wherein the antenna is made of a conductive paste.

9. The RFID tag of claim 1, further comprising a matching network.

10. The RFID tag of claim 9, wherein the matching network comprises a continuous matching loop formed on the inner surface of the base substrate that surrounds the RFID integrated circuit chip.

11. The RFID tag of claim 10, wherein the matching loop and the dipole arms together form an H-slot on the inner surface of the base substrate that is centered on the RFID integrated circuit chip.

12. A three-dimensional antenna comprising:

multiple othrogonal substrates including a base substrate, opposed parallel first and second end substrates that extend upward from the base substrate, and opposed parallel first and second lateral substrates that extend upward from the base substrate, the end substrates and the lateral substrates being perpendicular to the base substrate, each substrate having an inner surface and an outer surface; and a first three-dimensional dipole arm and a second three-dimensional dipole arm, each dipole arm extending outward from a center of the base substrate in opposite directions along the inner surface of the base substrate, extending up the inner surface of one of the end substrates, and further extending along the inner surface of one of the lateral substrates, wherein the two dipole arms are anti-symmetrical to each other.

13. The antenna of claim 12, wherein each dipole arm comprises a first meandered portion formed on the inner surface of the base substrate and a second meandered portion formed on the inner surface of one of the end substrates.

14. The antenna of claim 12, further comprising a matching network that includes a continuous matching loop formed on the inner surface of the base substrate.

15. The antenna of claim 13, wherein the first meandered portion of each dipole arm comprises a first longitudinal segment that extends toward one of the end substrates, a first transverse segment that extends toward one of the lateral substrates, a second longitudinal segment that extends toward one of the end substrates, and a second transverse segment that extends toward one of the lateral substrates.

16. The antenna of claim 15, wherein the second meandered portion of each dipole arm comprises a first vertical segment that extends upward away from the base substrate, a first horizontal segment that extends toward one of the lateral substrates, a second vertical segment that extends upward away from the base substrate, and a second horizontal segment that extends toward one of the lateral substrates.

17. The antenna of claim 16, wherein each dipole arm further comprises a horizontal segment that extends along one of the lateral substrates.

18. The antenna claim 14, wherein the matching loop and the dipole arms together form an H-slot on the inner surface of the base substrate.

19. The antenna of claim 12, wherein the substrates together form an open-topped rectangular hexahedron in which the antenna is formed.

20. The antenna of claim 12, wherein the antenna is formed using an additive manufacturing technique in which conductive material is deposited on the substrates.

21. The antenna of claim 20, wherein the substrates are made of acrylonitrile butadiene styrene (ABS).

22. The antenna of claim 21, wherein the antenna is made of a conductive paste.

23. The RFID tag of claim 5, wherein the first meandered portion of each dipole arm comprises a first longitudinal segment that extends toward one of the end substrates, a first transverse segment that extends toward one of the lateral substrates, a second longitudinal segment that extends toward one of the end substrates, and a second transverse segment that extends toward one of the lateral substrates.

24. The RFID tag of claim 23, wherein the second meandered portion of each dipole arm comprises a first vertical segment that extends upward away from the base substrate, a first horizontal segment that extends toward one of the lateral substrates, a second vertical segment that extends upward away from the base substrate, and a second horizontal segment that extends toward one of the lateral substrates.

25. The RFID tag of claim 24, wherein each dipole arm further comprises a horizontal segment that extends along one of the lateral substrates.

* * * * *